United States Patent [19]

Laxo

[11] 4,197,806

[45] Apr. 15, 1980

[54] SELECTIVE WEIGHT RELEASE

[75] Inventor: Darryl E. Laxo, Novato, Calif.

[73] Assignee: The United States of America as represented by the Secretary of the Navy, Washington, D.C.

[21] Appl. No.: 921,393

[22] Filed: Jul. 3, 1978

[51] Int. Cl.[2] ..... B63G 8/14

[52] U.S. Cl. ..... 114/331

[58] Field of Search ..... 114/331, 332; 244/93, 244/94, 137 R, 147

[56] References Cited

U.S. PATENT DOCUMENTS

| | | | |
|---|---|---|---|
| 1,207,851 | 12/1916 | Buerke | 114/331 |
| 1,764,979 | 6/1930 | Plum | 114/331 |
| 1,800,976 | 4/1931 | Andrews | 114/331 |

*Primary Examiner*—Trygve M. Blix
*Assistant Examiner*—Jesus D. Sotelo
*Attorney, Agent, or Firm*—R. S. Sciascia; Charles D. B. Curry; George L. Craig

[57] ABSTRACT

A method and apparatus is provided allowing submersible vessels to selectively control buoyancy by use of a simple, selective weight release system. A stacked series of weights varying in shape, size or composition is releasably held on a rotating shaft. Orientation of the weight on the shaft and its location in the stack determine when it is released from the shaft.

6 Claims, 3 Drawing Figures

SELECTIVE WEIGHT RELEASE

BACKGROUND OF THE INVENTION

1. Field of the Invention

The invention relates generally to a system for controlling buoyancy of submersible vehicles. More specifically, the invention relates to a buoyancy control system employing a selective weight release mechanism. In particular, the invention relates to buoyancy control by a very precise selective weight release system employing in part weights varying in number, size, and/or composition and having the potential for pre-programming diving profiles of such submersibles.

2. Description of Prior Art

Prior art weight release devices have several limitations. First, they are generally composed of a number of extremely complex mechanical linkages requiring fine tolerances and are subsequently often unreliable when actuated resulting in too much weight being released or none being released at all. Corrosion, inadequate lubrication and expansion/contraction binding of the many metal parts are but a few of the factors affecting reliability and these factors are omnipresent considerations for machinery operated in marine environments. A second limitation is that most conventional weight release devices are configured such that most or all of the weight to be released is a significant portion of the submersible's hull, usually occurring as all or a major portion of the vessel's keel. Thus activation of the weight release mechanism is generally coincident with impairment of the navigability of the vessel due to loss of the keel or parts thereof. A third limitation is that conventional weight release mechanisms are directed toward loss of large amounts of weight in emergency situations to effect bringing the submersible to the surface immediately. Precise depth control of the submersible by release of selected types and numbers of weights not forming a portion of the submersible's hull has not been attempted.

The instant invention is directed toward a method of overcoming the limitations described above as well as providing additional advantages not available with conventional weight release systems.

SUMMARY OF THE INVENTION

The instant invention is summarized as a method and apparatus which allows submersible vessels to selectively control buoyancy by means of a simple, selective weight release system. A stacked series of weights varying in shape, size or composition is releasably held on a rotating shaft. Orientation of the weight on the shaft and its location in the stack determine when it is released from the rotating shaft.

A primary object of invention is to provide a precise submersible depth control mechanism employing selective weight release.

A further object of invention is to provide a method and apparatus for pre-programming dive profiles for submersible vehicles as well as providing positive buoyancy in an emergency through selective weight release.

Still another object of invention is to provide a selective weight release mechanism for precise buoyancy control that itself is quite simple and does not require precision manufacture of the weights to be released or the release mechanism.

DESCRIPTION OF THE PREFERRED EMBODIMENT

Figure 1:
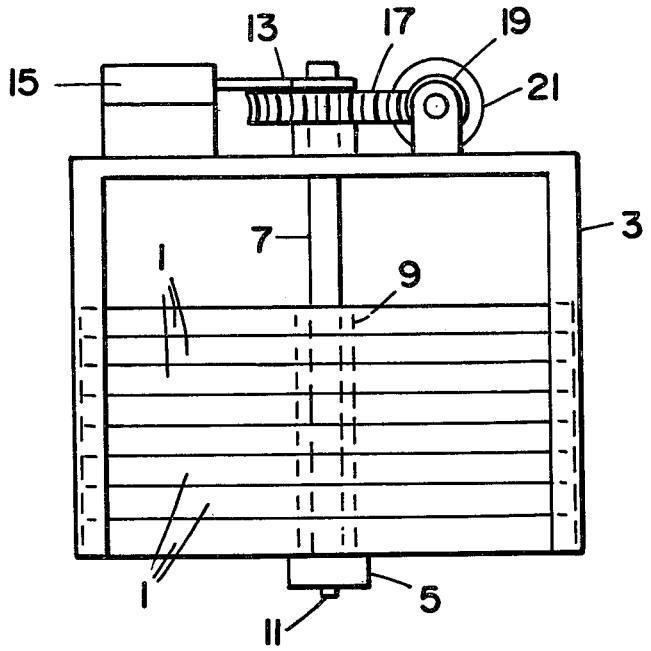
FIG. 1 is an elevation view of the weight release mechanism.
Figure 2:
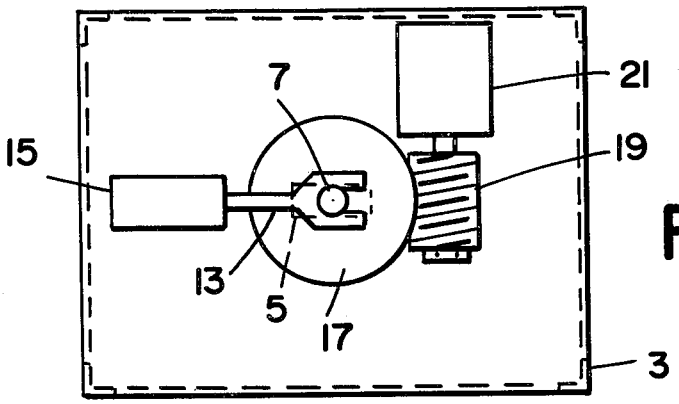
FIG. 2 is a plan view of the weight release mechanism.
Figure 3:
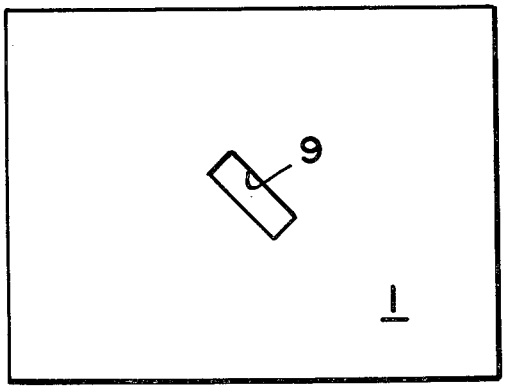
FIG. 3 is a view of a single weight and the hold-/release mechanism.

Referring to FIGS. 1 and 2, a stack of weights 1 is held within a set of guides 3 by a tee bar 5 affixed to the end of a shaft 7 extending through slots 9 in the center of the weights 1. The tee bar 5 is affixed to the shaft 7 by any suitable means such as a threaded screw 11. The top of the shaft 7 is releasably engaged by a yoke 13 connected to a release mechanism 15. Rotation of the shaft 7 is achieved by a gear 17 mounted on the shaft 7 below the yoke 13 such that the gear 17 engages a worm 19 driven by a motor 21. The motor 21 is powered by a remote source, not shown. A limit switch, not shown, connected between a shaft rotation pickup, not shown, and the motor 21 turns off the motor whenever the shaft has been turned through some angle of rotation adjustable by variation of the limit switch settings. The switch is then reset for the next period of operation of the motor 21. Referring to FIG. 3, a single weight 1 having a slot 9 is held in position by virtue of the tee bar 5 being in some angular position such that it is not aligned with the slot 9.

In operation, the shaft 7 is disengaged from the yoke 13 by first actuating the release mechanism 15 and then unscrewing the screw 11 from the shaft 7 such that the tee bar 5 is released. Shaft 7 is then removed and weights 1 are placed on it in any desired order of orientation of slot 9, thickness, number or composition. The tee bar 5 is then affixed again to shaft 7 by means of screw 11 and the total assembly re-engaged with yoke 11 after the release mechanism 15 has been reset. Actuation of the motor 21 causes the worm 19 engaged with the gear 17 to turn the shaft 7 and the attached tee bar 5. During rotation through the angle pre-set into motor 21, the tee bar 5 will become aligned with one or more slots 9 of one or more weights 1 at the bottom of the stack and these weights will drop away from the shaft 7. The remaining weights 1 will settle on the tee bar 5 until the motor 21 is reset and actuated again.

The slots 9 in the rectangular weights 1 are shown oriented at a 45° angle to the major axis of the rectangle. Further, as currently employed, the instant invention allows a 60° angle of rotation of the shaft 7 before the motor 21 is stopped by means of limit switches. Obviously, other slot orientations and shaft rotation limits may be used to fit specific employments of the instant device. The three particular advantages of the instant device are (a) simplicity and freedom from severe tolerance requirements, (b) great variation in weight design as required by particular dive requirements, and (c) capability to pre-program a particular dive profile by proper sequencing of weight type, location, and slot orientation on the tee bar 5.

Emergency operation of the instant device is achieved by actuating the release mechanism 15 which subsequently withdraws the yoke 13 from the shaft 7 and allows the entire weight stack to drop at once.

What is claimed is:

1. A selective weight release mechanism for a submersible vehicle comprising:

(a) a plurality of vertically stacked weights, each of said weights having selectively predetermined composition and having a central bore therethrough, said weights having at least two selective values and independent of the keel of said vehicle;

(b) means for releasably holding said weights;

(c) means for rotating said holding means through a specific angle of rotation such that at least one of said weights is released upon actuation of said rotating means; and (d) means for releasing said holding means and all of said weights when actuated.

2. A selective weight release mechanism as described in claim 1 wherein said weights have a general platelike rectangular shape.

3. A selective weight release mechanism as described in claim 1 wherein said bores in said weights are slots oriented at a 45° angle to the major axis of said platelike weight.

4. A selective weight release mechanism as described in claim 1 wherein said holding means includes:

(a) a guide to contain said weights, said guide preventing lateral movement of said weights;

(b) means for retaining said weights in a vertical stack within said guide, said retaining means having a vertical axial shaft;

(c) a gear rotatably connected to said vertical axial shaft of said retaining means, said gear lying above said weights; and (d) a tee bar connected to said retaining means, said tee bar having dimensions slightly smaller than said central bores of said platelike weights such that when said tee bar is aligned with said central bores of said platelike weights at the bottom of said stack, said weights are released from said retaining means.

5. A selective weight release mechanism as described in claim 4 wherein said release mechanism includes:

(a) a worm connected to said gear on said retaining means such that rotation of said worm causes rotation of said gear causing rotation of said retaining means; and (b) motor for driving said worm through a specific angle of rotation during operation, said motor operably connected to said worm and having controllable angle settings.

6. A selective weight release mechanism as recited in claim 1 wherein said releasing means includes:

(a) a yoke releasably engaging said holding means; and (b) means for retracting said yoke from said holding means upon activation of said retracting means.

* * * * *